US005477643A

United States Patent [19]

Koenig, Jr.

[11] Patent Number: 5,477,643

[45] Date of Patent: Dec. 26, 1995

[54] PANEL EDGE-FINISHING ACCESSORY

[75] Inventor: Joseph M. Koenig, Jr., Lincolnwood, Ill.

[73] Assignee: Trim-Tex, Inc., Lincolnwood, Ill.

[21] Appl. No.: 320,579

[22] Filed: Oct. 11, 1994

[51] Int. Cl.[6] ..... E04B 2/00

[52] U.S. Cl. ..... 52/100; 52/288.1; 52/468; 52/471; 52/573.1

[58] Field of Search ..... 52/98, 100, 288.1, 52/417, 418, 468, 471, 573.1

[56] References Cited

U.S. PATENT DOCUMENTS

| | | | |
|---|---|---|---|
| 2,114,044 | 4/1938 | Bonnell | 20/74 |
| 2,593,859 | 4/1952 | Dunlap | 20/74 |
| 2,862,264 | 12/1958 | Perna | 20/74 |
| 2,904,992 | 9/1959 | Cruser | 52/573.1 X |
| 3,113,401 | 12/1963 | Rose | 52/417 |
| 3,255,561 | 6/1966 | Cable | 52/288.1 X |
| 3,444,657 | 5/1969 | Swanson | 52/288 |
| 3,868,804 | 3/1975 | Tantlinger | 52/98 |
| 4,074,478 | 2/1978 | Rutherford | 52/98 |
| 4,288,016 | 9/1981 | Failla et al. | 227/30 |
| 4,313,991 | 2/1982 | Lamb | 428/131 |
| 4,722,153 | 2/1988 | Hardy | 52/255 |
| 4,825,612 | 5/1989 | Tipman | 52/288.1 X |
| 4,835,925 | 6/1989 | Hoffmann, Sr. | 52/288 |
| 4,932,183 | 6/1990 | Coulston | 52/417 |
| 4,977,718 | 12/1990 | Hoffman, Sr. | 52/288 |
| 5,243,797 | 9/1993 | Koenig, Jr. | 52/254 |
| 5,313,755 | 5/1994 | Koenig, Jr. | 52/255 |

FOREIGN PATENT DOCUMENTS

| | | | |
|---|---|---|---|
| 2335980 | 1/1975 | Germany | 52/98 |

OTHER PUBLICATIONS

Catalog, Trim–Tex, Inc., Apr. 1993—generally and under "Adjustable Inside Corner Bead" on p. 5, under New Magic Corner, on p. 5, and under Hideaway Expansion Joint on p. 7.

*Primary Examiner*—Carl D. Friedman
*Assistant Examiner*—Aimee McTigue
*Attorney, Agent, or Firm*—Dressler, Goldsmith, Shore & Milnamow, Ltd.

[57] ABSTRACT

A panel edge-finishing accessory which is useful as an expansion joint between two drywall panels comprises three integrally joined, elongate strips, namely two relatively rigid, lateral strips and a relatively pliable, middle strip, which may be respectively coextruded from polyvinyl chloride having different durometer hardnesses. Each lateral strip has a broad portion with a distal edge and a proximal edge, a rib with a distal edge and a proximal edge merging with the proximal edge of such lateral strip, and a tear-away flange joined integrally to the distal edge of the rib at a preferentially weakened juncture. The middle strip has a zig-zag profile and is joined integrally at each of its opposite edges to the distal edge of the rib of one of the lateral strips. The ribs extend so as to be generally normal to the lateral strips and are used for guiding a tool used to apply drywall-finishing material over the lateral strips. The tear-away flanges are used for protecting the middle strip from drywall-finishing material applied over the lateral strips by a tool guided by the ribs and are intended to be torn away, along the preferentially weakened junctures, after drywall-finishing material thus has been applied. Each lateral strip has a locating flange extending oppositely from the proximal edge of such lateral strip.

6 Claims, 1 Drawing Sheet

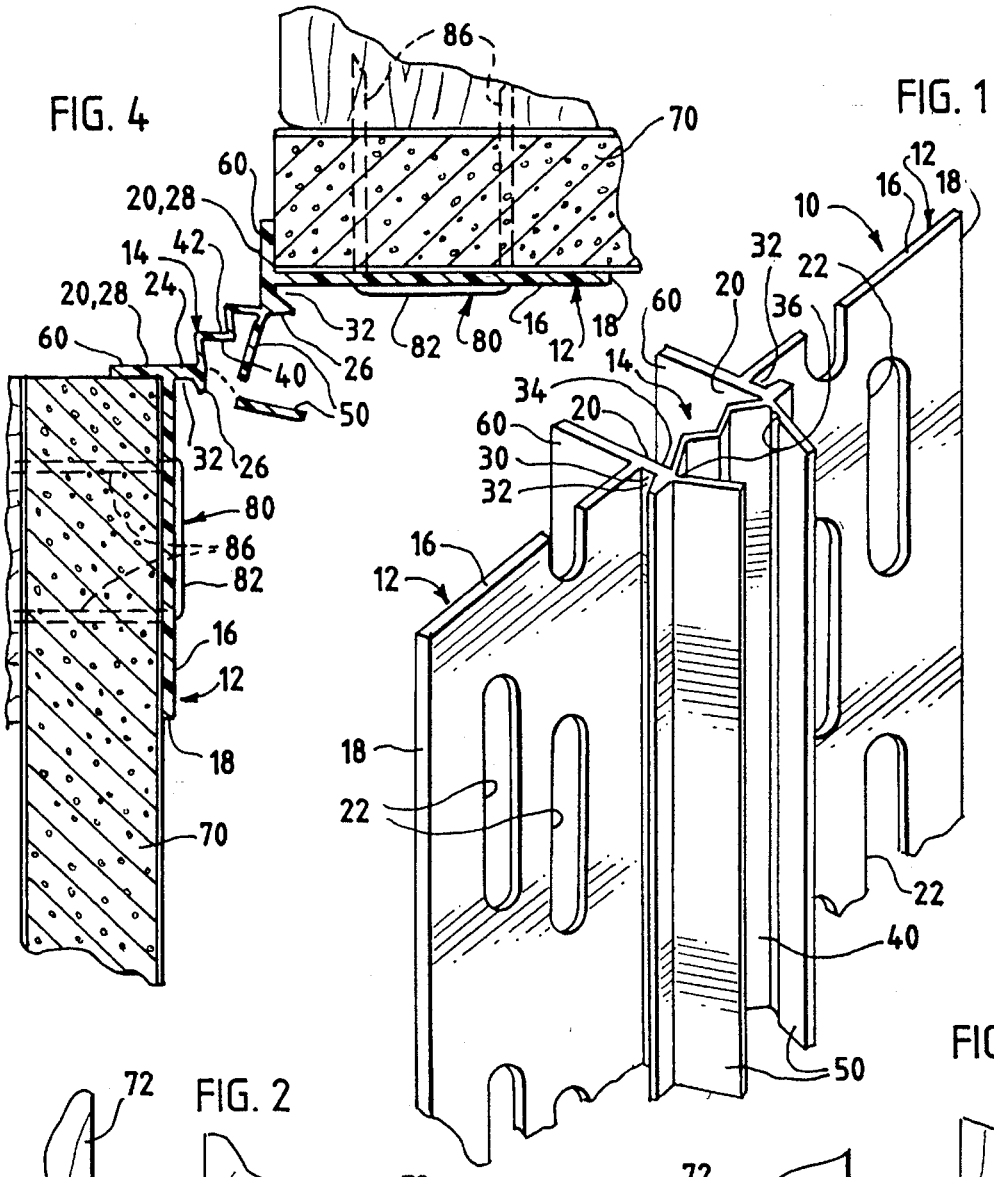
FIG. 4
FIG. 1
86
70
60
20,28
14
42
24
32
26
40
50
82
80
16
12
18
10
22
36
20
34
30
40
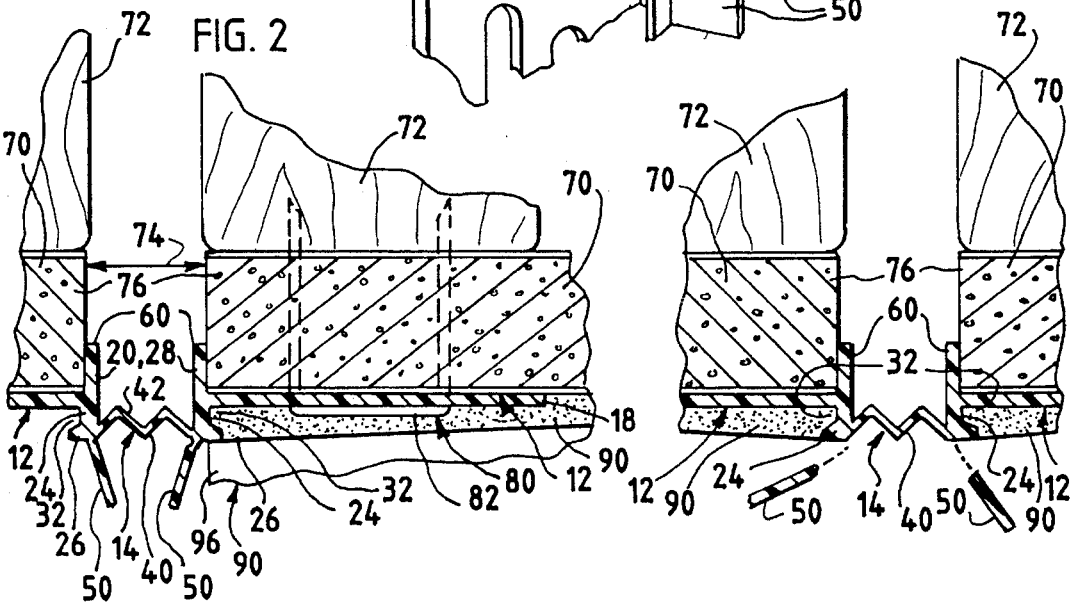
FIG. 2
FIG. 3
72
70
74
76
60
20,28
42
12
24
32
26
14
40
50
96
90
18
82
80
32

PANEL EDGE-FINISHING ACCESSORY

TECHNICAL FIELD OF THE INVENTION

This invention pertains to a panel edge-finishing accessory, which is useful as an expansion joint between two panels, such as two drywall panels. At least one tear-away flange is provided, which protects a pliable, middle strip from drywall-finishing material or other finishing material being applied over a lateral strip of the accessory.

BACKGROUND OF THE INVENTION

As illustrated and described in Koenig, Jr., U.S. Pat. No. 5,313,755, a drywall corner-finishing accessory comprises three integrally joined, elongate strips, namely two relatively rigid, lateral strips and a relatively pliable, middle strip, which may be respectively coextruded from polyvinyl chloride having different durometer hardnesses. Each lateral strip has a rib along one edge. At its opposite edges, the middle strip is joined to the lateral strips at the distal edge of the ribs, so that a broad surface of the middle strip is stepped from the lateral strips.

As illustrated and described therein, the drywall corner-finishing accessory is flexible along the middle strip selectively to define a stepped, inside corner and a stepped, outside corner. The rib of each lateral strip guides a drywall-finishing tool and has a grooved pocket opening toward the distal edge of such lateral strip to receive drywall-finishing material.

Although the drywall-corner finishing accessory illustrated and described therein can be also used as an expansion joint between two drywall panels, it has been found to be a practical necessity either to mask the middle strip, as with masking tape, when drywall-finishing material is applied over the lateral strips or to clean such material from the middle strip after such material has been applied over the lateral strips, before the accessory and the applied material are finished, as by painting or wallpapering. Otherwise, as the drywall panels expand or contract so as to flex the middle strip, any finishing material remaining on the middle strip and painted may have a tendency to crack or to separate from the middle strip so that the expansion joint may need to be then refinished at least along the middle strip.

This invention provides improvements over the drywall corner-finishing accessory illustrated and described in Koenig, Jr., U.S. Pat. No. 5,313,755.

SUMMARY OF THE INVENTION

This invention provides a panel edge-finishing accessory, which is useful as an expansion joint between two panels, such as two drywall panels. The panel edge-finishing accessory comprises three integrally joined, elongate strips, namely two relatively rigid, lateral strips and a relatively pliable, middle strip. This invention provides that the middle strip, which may have a zig-zag profile, is protected from finishing material being applied.

Each lateral strip has a broad portion with a distal edge and a proximal edge and a rib with a distal edge and a proximal edge merging with the proximal edge of such lateral strip. The panel edge-finishing accessory is improved over the drywall corner-finishing accessory described above in that at least one of the lateral strips also has a tear-away flange, which is joined to the distal edge of the rib of such lateral strip at a preferentially weakened juncture. Preferably, each lateral strip has such a tear-away flange.

The ribs constitute means for guiding a tool used to apply finishing material over the lateral strips. The panel edge-finishing accessory is improved over the drywall corner-finishing accessory described above in that each tear-away flange constitutes means for protecting the middle strip from finishing material thus being applied and for being torn away, along the preferentially weakened junctures, after finishing material thus has been applied.

Preferably, on each lateral strip, such a tear-away flange is joined to the distal edge of the rib at the preferentially weakened juncture. Preferably, moreover, the middle strip is joined at each of the opposite panel edges to the distal edge of the rib of one of the lateral strips. Preferably, furthermore, the rib of each lateral strip extends outwardly from the proximal edge of such lateral strip and wherein each lateral strip has a locating flange extending inwardly from the proximal edge of such lateral strip.

Although the panel edge-finishing accessory provided by this invention can be advantageously used with drywall panels and with drywall-finishing material, it may be alternatively useful with other panels and with other finishing material, such as stucco.

These and other objects, features, and advantages of this invention are evident from the following description of a preferred embodiment of this invention with reference to the accompanying drawings.

BRIEF DESCRIPTION OF THE DRAWINGS

FIG. 1 is a fragmentary, perspective view of a panel edge-finishing accessory constituting a preferred embodiment of this invention.

FIG. 2 is a fragmentary, cross-sectional view of the same accessory, as used as an expansion joint between two drywall panels, which overlie wooden studs, which are aligned with each other, and to which such accessory is stapled. Also, FIG. 2 shows drywall-finishing material being applied over one lateral strip of such accessory, via a drywall-finishing tool, which is shown fragmentarily.

FIG. 3 is a fragmentary, cross-sectional view similar to FIG. 2 but taken after drywall-finishing material has been applied over both lateral strips of such accessory and after the tear-away flanges of such accessory have been torn away.

FIG. 4 is a fragmentary, cross-sectional view of the same accessory, as used as an expansion joint between two drywall panels, which are fastened to wooden studs, which are oriented so as to define an inside corner, and to which such accessory is stapled.

DETAILED DESCRIPTION OF THE PREFERRED EMBODIMENT

As shown in FIG. 1, a panel edge-finishing accessory 10 constitutes a preferred embodiment of this invention. Basically, the accessory 10 comprises three integrally joined, elongate strips, namely two relatively rigid, lateral strips 12 and a relatively pliable, middle strip 14.

Preferably, the lateral strips 12 and the middle strip 14 are coextruded from a relatively rigid, polymeric material for the lateral strips 12 and a relatively pliable, polymeric material for the middle strip 14. Preferably, the relatively rigid, polymeric material and the relatively pliable, polymeric material are polyvinyl chloride having different durometer hardnesses.

Each lateral strip 12 has a broad portion 16 with a generally uniform thickness (e.g., about 0.04 inch) and with a distal edge 18, a proximal edge 20 and two rows of elongate slots 22. Holes may be used instead of slots. Each lateral strip 12 also has a rib 24 with a distal edge 26 and a proximal edge 28 merging with the proximal edge 20 of the broad portion 16 of such lateral strip 12. The rib 24 of each lateral strip 12 has a lateral surface 30 facing the distal edge 18 of such lateral strip 12 and a lateral surface 34 facing oppositely. The rib 24 of each lateral strip 12 has a grooved pocket 32 to receive drywall-finishing material, which pocket 32 opens at the lateral surface 30 of the rib 24, toward the distal edge 26 of such lateral strip 12.

The middle strip 14 is wide (e.g., about 0.3125 inch wide) and has two opposite edges 36 and a generally uniform thickness (e.g., about 0.05 inch) substantially between the opposite edges 36. As shown in FIG. 1, when the accessory 10 is unstressed, the middle strip 14 has a zig-zag profile. The middle strip 14 is joined integrally at each of the opposite edges 36 to the rib 24 of one of the lateral strips 12, specifically to the lateral surface 34 of the rib 24 thereof, so that one broad surface 40 of the middle strip 14 merges with the distal edges 26 of the ribs 24. The middle strip 14 has a broad surface 42 opposite to the broad surface 40 merging therewith. As shown in FIG. 1, when the accessory 10 is unstressed, each of the broad surfaces 40, 42, of the middle strip 14 has a zig-zag profile. Moreover, the distal edges 26 of the ribs 24 and the broad surface 40 of the middle strip 14 are stepped (e.g., by about 0.085 inch at such edges 26) from the broad portions 16 of the lateral strips 12.

The rib 24 of each lateral strip 12 may be conveniently regarded as extending outwardly from such lateral strip 12. Each lateral strip 12 is extruded so as to have the rib 24 of such lateral strip 12 and so as to have a tear-away flange 50, which is joined integrally to the distal edge 26 of the rib 24 of such lateral strip 12 at a preferentially weakened juncture 52, and which extends outwardly from the rib 24 of such lateral strip 12. Each lateral strip 12 is extruded so as to have a locating flange 60, which is joined integrally to the proximal edge 20 of such lateral strip 12, and which extends inwardly from the proximal edge 20 of such lateral strip 12.

As shown in FIG. 2, the accessory 10 is useful as an expansion joint between two drywall panels 70, which are fastened to wooden studs 72, and which are aligned with one another with a space 74 provided between the near edges 76 of the drywall panels 70 to accommodate the accessory 10. As shown therein, the accessory 10 is stapled to the drywall panels 70 with the broad portion 16 of each lateral strip 12 against a corresponding panel 70 and with the locating flange 60 of such lateral strip 12 against the near edge 76 of the corresponding panel 70, via staples 80 having their heads 82 bearing against the broad portions 16 of the lateral strips 12 and having their legs 84 passing through the lateral strips 12, through the drywall panels 70, into the wooden studs 72.

After the accessory 10 has been stapled to the drywall panels 70, drywall-finishing material 90 is applied over the broad portions 16 of the lateral strips 12, over adjacent areas 92 of the drywall panels 70, and into the grooved pockets 32, via a drywall-finishing tool 94 having a straight-edged blade 96, which is guided by the ribs 24 and by those areas 92 of the drywall panels 70. As applied over the broad portions 16 of the lateral strips 12, drywall-finishing material 90 penetrates the elongate slots 22 to reach the underlying areas of the drywall panels 70.

While drywall-finishing material 90 is being applied, the tear-away flanges 50 protect the middle strip 14 from such material 90 being applied. Thus, there is no further necessity either to mask the middle strip 14, as with masking tape, when drywall-finishing material 90 is applied over the lateral strips 12 or to clean such material 90 from the middle strip 14 after such material 90 has been applied over the lateral strips 12, before the accessory 10 and the applied material 90 are finished.

As shown in FIG. 3, the tear-away flanges 50 are torn away, along the preferentially weakened junctures 52, after the applied material 90 has cured. The cured material 90 and the stepped surface 40 of the middle strip 14 may be then covered with paint, wallpaper, or other wall-covering material. If it is desired to paint the cured material 90 but not to paint the stepped surface 40 of the middle strip 14, the tear-away flanges 50 may be optionally left on while the applied material 90 is being painted, whereupon the tear-away flanges 50 are torn away.

As shown in FIG. 4, this invention also contemplates that the accessory 10 may be alternatively used as an expansion joint between two drywall panels 70, which are fastened to wooden studs 72, and which are oriented so as to define an inside corner with a space 74 provided between the near edges 76 of the drywall panels 70 to accommodate the accessory 10. As shown therein, it may be then necessary for one of the tear-away flanges 50 to be initially torn away so that the tear-away flanges do not interfere with one another.

Moreover, this invention contemplates that the accessory 10 may be alternatively used as an expansion joint between two drywall panels (not shown) defining an outside corner. It may be then necessary to omit the locating flanges 60.

Various other modifications may be made in the preferred embodiment described above without departing from the scope and spirit of this invention.

I claim:

1. A panel edge-finishing accessory useful as an expansion joint and comprising three integrally joined, elongate strips, which includes two relatively rigid, lateral strips and a relatively pliable, middle strip, each lateral strip having a broad portion with a distal edge and a proximal edge, a rib with a distal edge and a proximal edge merging with the proximal edge of such lateral strip, and a tear-away flange joined integrally to the rib at a weakened juncture, the middle strip having two opposite edges and being joined integrally at each of the opposite edges to the rib of one of the lateral strips, the ribs constituting means for guiding a tool used to apply finishing material over the lateral strips, the tear-away flanges constituting means for protecting the middle strip from finishing material thus being applied and for being torn away, along the weakened junctures, after finishing material thus has been applied.

2. The panel edge-finishing accessory of claim 1 wherein, on each lateral strip, the tear-away flange is joined integrally to the distal edge of the rib at the preferentially weakened juncture.

3. The panel edge-finishing accessory of claim 2 wherein the middle strip is joined integrally at each of the opposite edges to the distal edge of the rib of one of the lateral strips.

4. The panel edge-finishing accessory of claim 3 wherein the rib of each lateral strip extends outwardly from the proximal edge of such lateral strip and wherein each lateral strip has a locating flange extending inwardly from the proximal edge of such lateral strip.

5. The panel edge-finishing accessory of claim 1, 2, 3, or 4 wherein the middle strip has a zig-zag profile.

6. A panel edge-finishing accessory useful as an expansion joint and comprising three integrally joined, elongate strips, which includes two relatively rigid, lateral strips and a relatively pliable, middle strip, each lateral strip having a broad portion with a distal edge and a proximal edge and a rib with a distal edge and a proximal edge merging with the proximal edge of such lateral strip, at least one lateral strip having a tear-away flange joined integrally to the rib of the same strip at a weakened juncture, the middle strip having two opposite edges and being joined integrally at each of the opposite edges to the rib of one of the lateral strips, the ribs constituting means for guiding a tool used to apply finishing material over the lateral strips, the tear-away flange constituting means for protecting the middle strip from finishing material thus being applied and for being torn away, along the weakened juncture, after finishing material thus has been applied.

* * * * *

UNITED STATES PATENT AND TRADEMARK OFFICE

CERTIFICATE OF CORRECTION

PATENT NO. : 5,477,643

DATED : Dec. 26, 1995

INVENTOR(S) : Joel M. Koenig, Jr.

It is certified that error appears in the above-indentified patent and that said Letters Patent is hereby corrected as shown below:

Claim 2, column 4, line 53, delete "preferentially"

Signed and Sealed this

Twenty-sixth Day of March, 1996

*Attest:*

Bruce Lehman

BRUCE LEHMAN

*Attesting Officer*

*Commissioner of Patents and Trademarks*